US008170234B2

(12) United States Patent
Brooks et al.

(10) Patent No.: US 8,170,234 B2
(45) Date of Patent: May 1, 2012

(54) DECONVOLUTION METHODS AND SYSTEMS FOR THE MAPPING OF ACOUSTIC SOURCES FROM PHASED MICROPHONE ARRAYS

(75) Inventors: Thomas F. Brooks, Seaford, VA (US); William M. Humphreys, Jr., Newport News, VA (US)

(73) Assignee: The United States of America by the Administrator of the National Aeronautics and Space Adminstration, Washington, DC (US)

( * ) Notice: Subject to any disclaimer, the term of this patent is extended or adjusted under 35 U.S.C. 154(b) by 1042 days.

(21) Appl. No.: 12/108,562

(22) Filed: Apr. 24, 2008

(65) Prior Publication Data

US 2009/0052689 A1 Feb. 26, 2009

Related U.S. Application Data

(63) Continuation-in-part of application No. 11/126,518, filed on May 10, 2005, now Pat. No. 7,783,060.

(60) Provisional application No. 60/914,451, filed on Apr. 27, 2007.

(51) Int. Cl.
*H04R 3/00* (2006.01)

(52) U.S. Cl. ..... 381/92; 381/91; 381/122; 367/118; 367/119

(58) Field of Classification Search ..... 381/56, 381/91–92, 122, 356; 367/118–119, 138
See application file for complete search history.

(56) References Cited

U.S. PATENT DOCUMENTS 4,741,038 A * 4/1988 Elko et al. ..... 381/92
5,500,903 A * 3/1996 Gulli ..... 381/92
7,269,263 B2 * 9/2007 Dedieu et al. ..... 381/92

OTHER PUBLICATIONS

Thomas F. Brooks, "A Deconvolution Approach for the Mapping of Acoustic Sources (DAMAS) Determined from Phased Microphone Arrays," 10th AIAA/CEAS Aeroacoustics Conference, AIAA (Manchester, UK), (May 10, 2004).

* cited by examiner

*Primary Examiner* — Devona Faulk
*Assistant Examiner* — Disler Paul
(74) *Attorney, Agent, or Firm* — Robin W. Edwards; Helen M. Galus

(57) ABSTRACT

Mapping coherent/incoherent acoustic sources as determined from a phased microphone array. A linear configuration of equations and unknowns are formed by accounting for a reciprocal influence of one or more cross-beamforming characteristics thereof at varying grid locations among the plurality of grid locations. An equation derived from the linear configuration of equations and unknowns can then be iteratively determined. The equation can be attained by the solution requirement of a constraint equivalent to the physical assumption that the coherent sources have only in phase coherence. The size of the problem may then be reduced using zoning methods. An optimized noise source distribution is then generated over an identified aeroacoustic source region associated with a phased microphone array (microphones arranged in an optimized grid pattern including a plurality of grid locations) in order to compile an output presentation thereof, thereby removing beamforming characteristics from the resulting output presentation.

19 Claims, 13 Drawing Sheets

410

420

510

710

DECONVOLUTION METHODS AND SYSTEMS FOR THE MAPPING OF ACOUSTIC SOURCES FROM PHASED MICROPHONE ARRAYS

RELATED APPLICATIONS

This application is a continuation-in-part of the pending application Ser. No. 11/126,518, filed May 10, 2005 now U.S. Pat. No. 7,783,060 and claims priority to provisional patent application Ser. No. 60/914,451 filed on Apr. 27, 2007.

ORIGIN OF THE INVENTION

This invention was made by employees of the United States Government and may be manufactured and used by or for the Government of the United States of America for governmental purposes without the payment of any royalties thereon or therefor.

TECHNICAL FIELD

Embodiments are generally related to phased microphone arrays. Embodiments are also related to devices and components utilized in wind tunnel and aeroacoustic testing. Embodiments additionally relate to aeroacoustic tools utilized for airframe noise calculations. Embodiments also relate to any vehicle or equipment, either stationary or in motion, where noise location and intensity are desired to be determined.

BACKGROUND OF THE INVENTION

The specification of pending patent application Ser. No. 11/126,518, filed May 10, 2005, is hereby incorporated by reference in its entirety for its teaching (herein referred to as "the referenced Ser. No. 11/126,518").

Wind tunnel tests can be conducted utilizing phased microphone arrays. A phased microphone array is typically configured as a group of microphones arranged in an optimized pattern. The signals from each microphone can be sampled and then processed in the frequency domain. The relative phase differences seen at each microphone determines where noise sources are located. The amplification capability of the array allows detection of noise sources well below the background noise level. This makes microphone arrays particularly useful for wind tunnel evaluations of airframe noise since, in most cases, the noise produced by wings, flaps, struts and landing gear models will be lower than that of the wind tunnel environment.

The use of phased arrays of microphones in the study of aeroacoustic sources has increased significantly in recent years, particularly since the mid 1990's. The popularity of phased arrays is due in large part to the apparent clarity of array-processed results, which can reveal noise source distributions associated with, for example, wind tunnel models, and full-scale aircraft. Properly utilized, such arrays are powerful tools that can extract noise source radiation information in circumstances where other measurement techniques may fail. Presentations of array measurements of aeroacoustic noise sources, however, can lend themselves to a great deal of uncertainty during interpretation. Proper interpretation requires knowledge of the principles of phased arrays and processing methodology. Even then, because of the complexity, misinterpretations of actual source distributions (and subsequent misdirection of engineering efforts) are highly likely.

Prior to the mid 1980's, processing of array microphone signals as a result of aeroacoustic studies involved time delay shifting of signals and summing in order to strengthen contributions from, and thus "focus" on, chosen locations over surfaces or positions in the flow field. Over the years, with great advances in computers, this basic "delay and sum" processing approach has been replaced by "classical beamforming" approaches involving spectral processing to form cross spectral matrices (CSM) and phase shifting using increasingly large array element numbers. Such advances have greatly increased productivity and processing flexibility, but have not changed at all the interpretation complexity of the processed array results.

Some aeroacoustic testing has involved the goal of forming a quantitative definition of different airframe noise sources spectra and directivity. Such a goal has been achieved with arrays in a rather straight-forward manner for the localized intense source of flap edge noise. For precise source localization, however, Coherent Output Power (COP) methods can be utilized by incorporating unsteady surface pressure measurements along with the array. Quantitative measurements for distributed sources of slat noise have been achieved utilizing an array and specially tailored weighting functions that matched array beam patterns with knowledge of the line source type distribution for slat noise. Similar measurements for distributed trailing edge noise and leading edge noise (e.g., due in this case to grit boundary layer tripping) have bee performed along with special COP methodologies involving microphone groups.

The deconvolution methodology described in the referenced Ser. No. 11/126,518 gives a unique robust deconvolution approach designed to determine the "true" noise source distribution over an aeroacoustic source region to replace the "classical beamformed" distributions. However, that method, along with classical beamforming processing, employs statistically independent (incoherent) noise source distribution assumptions. Thus, it can produce results that are inaccurate and distorted in the presence of coherent sources, albeit a suitable solution for where non-coherent sources are involved. Using an equation form similar to that employed in the referenced Ser. No. 11/126,518, a solution appropriate to identify and quantify coherent as well as an incoherent sources is viable and will be herein fully described.

Example applications for the present invention include ideal point and line noise source cases, as well as conformation with well documented experimental airframe noise studies of wing trailing and leading edge noise, slat noise, and flap edge/flap cove noise.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for a method and system for mapping acoustic sources determined from microphone arrays.

It is another aspect of the present invention to provide for a "Deconvolution Approach for the Mapping of Acoustic Sources" (DAMAS) when such sources are coherent as well as incoherent (DAMAS-C), as determined from phased microphone arrays.

It is yet a further aspect of the present invention to provide for improved devices and components utilized in wind tunnel and aeroacoustic testing.

It is also an aspect of the present invention to provide for aeroacoustic tools utilized for airframe noise calculations.

The aforementioned aspects and other objectives and advantages can now be achieved as described herein. A method and system for mapping coherent and incoherent acoustic sources determined from a phased microphone array, comprising a plurality of microphones arranged in an optimized grid pattern including a plurality of grid locations thereof. Utilizing a method similar to that employed in the referenced Ser. No. 11/126,518, a linear configuration of equations and unknowns can be formed. The present method differs in that the terms of the equation are complex and the problem size for the same number of grid points is expanded. The DAMAS-C problem contains N(N+1)/2 potentially independent equations and unknowns. Certain methods are used to reduce the computational requirements of solving such a system. One or more equations among the linear configuration of equations and unknowns can then be iteratively determined.

In the referenced Ser. No. 11/126,518, the full-rank was attained by the solution requirement of the positivity constraint equivalent to the physical assumption of statically independent noise sources at each location. In the present application a similar restriction assumption is made where the coherence solutions should be specifically phase related (for applications of DAMAS-C where sources are limited as having only in-phase coherence, the constraint sets the value of the result from a previous iteration to zero when that result is not positive). Due to the significant computational requirements of applying DAMAS-C, a further reduction via zoning is employed Zoning is a method whereby evaluation is restricted to the possible solutions to anticipated or realizable conditions of the noise source evaluation region under study. A noise source distribution is then generated over identified aeroacoustic source regions associated with the phased microphone array in order to compile an output presentation thereof, in response to iteratively determining at least one equation among the linear configuration of equations and unknowns.

DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

Figures 1A, 1B, 1C, 1D:
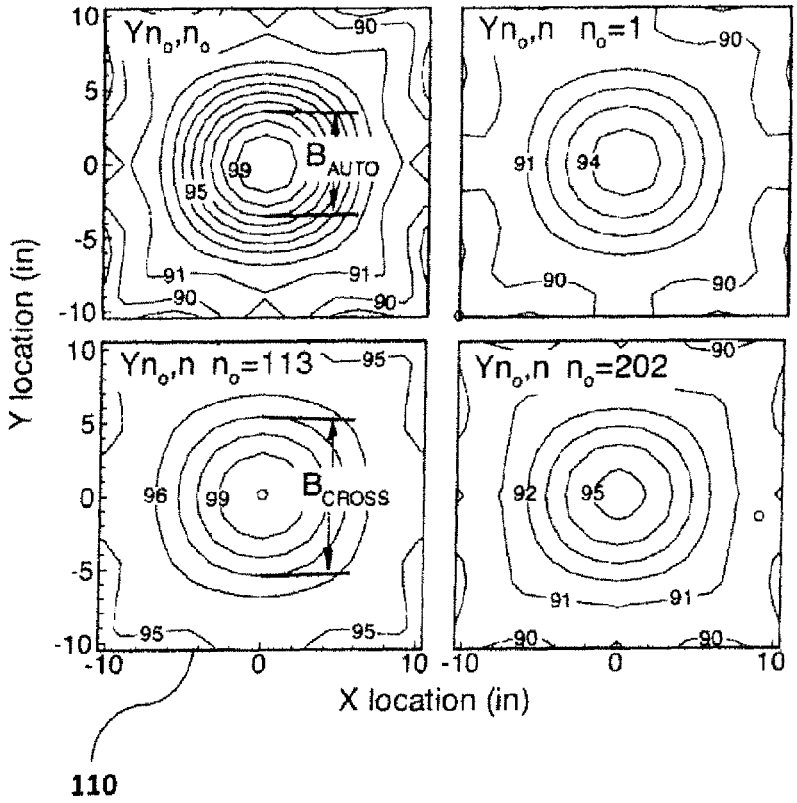
FIGS. 1A-D illustrate the output dB level contours over scan planes of beamforming and crass-beamforming for a single source.

The particular values and configurations discussed in these non-limiting examples can be varied and are cited merely to illustrate at least one embodiment and are not intended to limit the scope thereof. Additionally, acronyms, symbols, and subscripts utilized herein are summarized below.

SYMBOLS AND ACRONYMS $a_m$ shear layer refraction amplitude correction for $e_{mn}$
$A_C$ DAMAS-C matrix with $A_{n_0n,n'_0n'}$ ark components
$A_{n_0n,n'_0n'}$ reciprocal influence of cross-beamforming characteristics between grid points
B array half-power "beamwidth" of 3 dB down from beam peak maximum
$c_0$ speed of sound in medium in the absence of mean flow
CSM cross spectral matrix
$\overline{\gamma_{n_0n}^2}$ coherence between sources at $n_0$ and n
DR diagonal removal of G in array processing
$e_n$ steering vector for array for focus at grid point n
$e_{mn}$ component of $e_n$ for microphone m
f frequency
Δf frequency bandwidth resolution of spectra
$G_{mm'}$ cross-spectrum between $P_m$ and $P_{m'}$
G matrix (CSM) of cross-spectrum elements $c_{mm'}$
H height of chosen scan plane
i iteration number
m microphone identity number in array
m' same as m, but independently varied
$m_0$ total number of microphones in array
n grid point number on scanning plane(s)
n',$n_0$,$n_0$' same as n but independently varied
M wind tunnel test Mach number
X total number of grid points over scanning plane(s)
$p_m$ Fourier Transform of pressure time history at microphone m
QFF Quiet Flow Facility
$Q_n$ idealized $p_m$ for modeled source at n for quiescent acoustic medium $r_c$ distance $r_m$ for m equal to the center of the microphone array $\tau_m c_0$ retarded coordinate distance from focus point to SADA Small Aperture Directional Array STD standard or classical array processing T complex conjugate transpose (superscript)

$\tau_m$ propagation time from grid point to microphone m $w_m$ frequency dependent shading (or weighting) for m $\hat{W}$ shading matrix of $w_m$ terms W width of scanning plane $\Delta x$ widthwise spacing of grid points $\hat{X}_c$ matrix of ($X_{non}$) terms $n_{nono}$ (auto) spectrum of "noise source" at grid point $n_o$ with levels defined at array, $Q^*_{no}Q_{no}$ $X_{non}$ cross-spectrum between sources at $n_o$ and n($=Q^*_{no}Q_n$)

$\Delta y$ heightwise spacing of grid points $\hat{Y}_C$ matrix of $Y_{non}$ terms $Y_{nono}$ beamform power response of array at focus location $n_o$ $Y_n$ of ref. app.

$Y_{non}$ cross-beamform power response between locations $n_o$ and n

The first step in a DAMAS-C formulation is to cross beamform over the source region. FIGS. 1A-D illustrate graphs representing output dB contours over scan planes of Beamforming, and $Y_{non_o}$ and cross beamforming. The referenced Ser. No. 11/126,518 describes, in detail, traditional beamforming methods. For the present analysis, the cross beamform product is indicated in equation (1) below:

$$Y_{n_o n} = \frac{\hat{e}^T_{n_o}\hat{G}\hat{e}_n}{m_o^2} \tag{1}$$

The cross-spectral matrix (CSM) is G, where $$\hat{G} = \begin{bmatrix} G_{11} & G_{12} & \dots & G_{1m_0} \\ \vdots & G_{22} & & \vdots \\ \vdots & & \ddots & \vdots \\ G_{m_0 1} & & & G_{m_0 m_0} \end{bmatrix} \tag{2}$$

and $m_0$ is the total number of microphones in the array. This is a beamform cross-spectrum of the array between focused locations of grid points at $n=n_o$ and at another n. The equivalent steering "vectors" to those in the referenced Ser. No. 11/126,518 are indicated by equations (3) and (4) below:

$$\hat{e}_{n_o} = \mathrm{col}[e_{1n_0} e_{2n_0} \dots e_{m_0 n_0}] \tag{3}$$

and $$\hat{e}_n = \mathrm{col}[e_{1n} e_{2n} \dots e_{m_0 n}] \tag{4}$$

Figure 2:
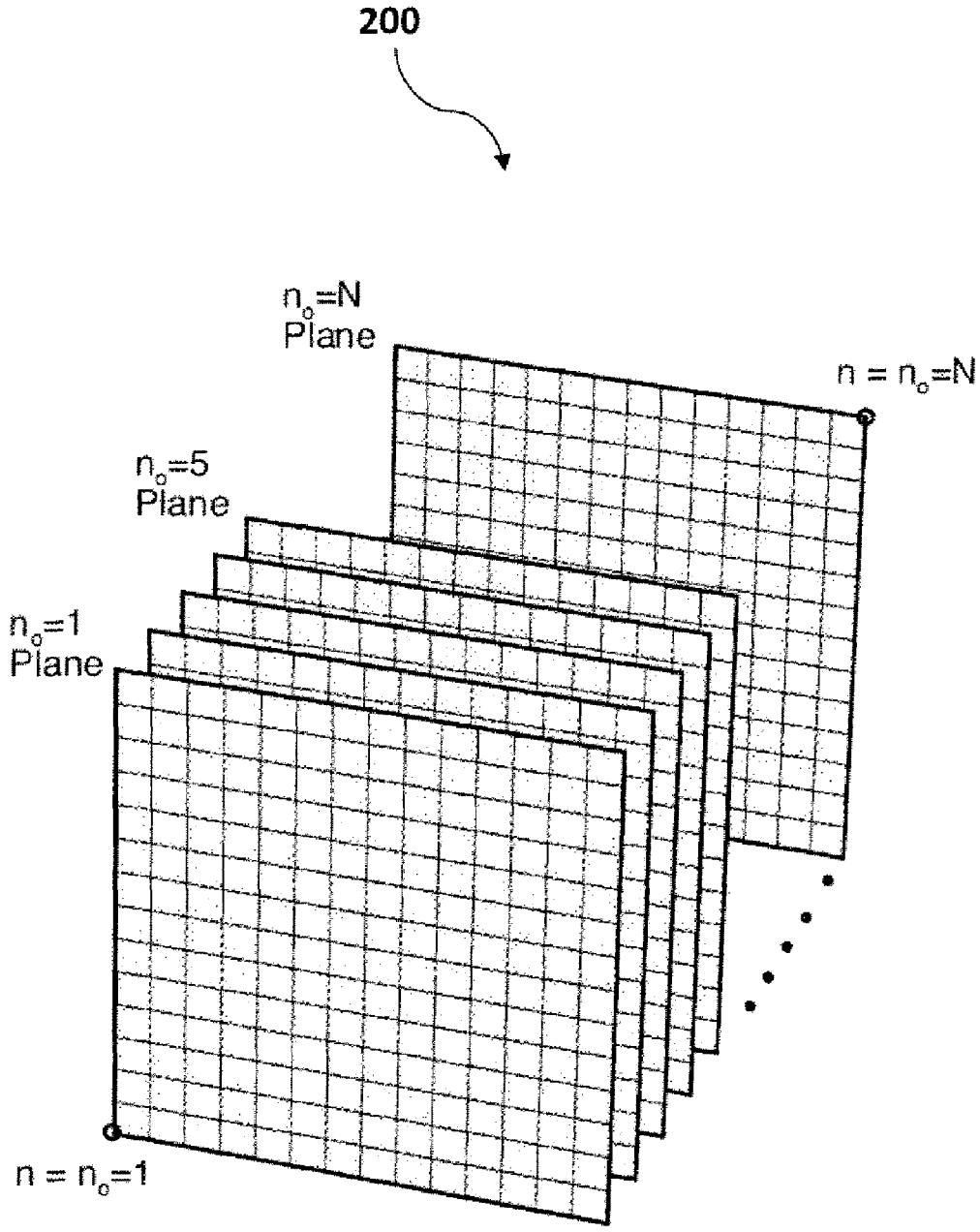
FIG. 2 illustrates a stack of individual $n_o$ planes defining a survey and solution space.
Figures 3A, 3B, 3C, 3D:
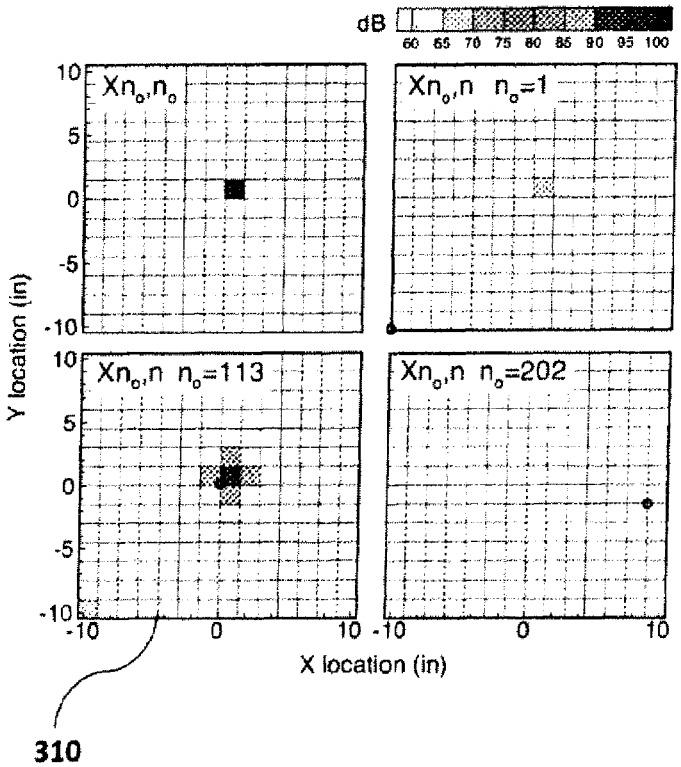
FIGS. 3A-D illustrate results of DAMAS source strengths and cross strengths between grid points at $n_o$ and n over scan planes corresponding to FIGS. 1A-D.
Figures 4A, 4B, 4C, 4D, 4E, 4F:
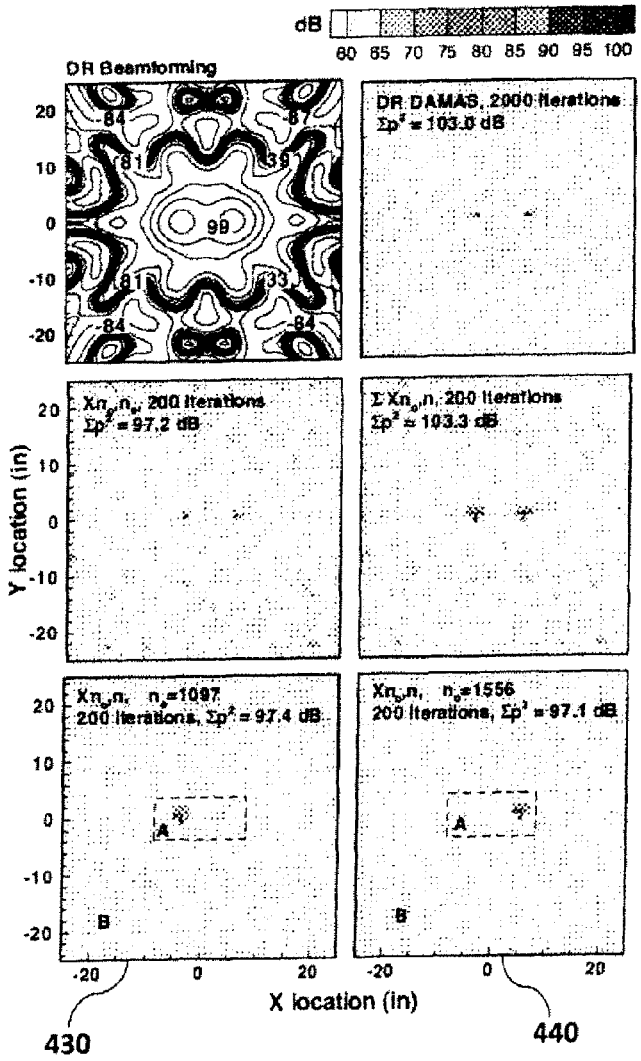
FIGS. 4A-F illustrate beamforming and corresponding results for both DAMAS and DAMAS-C based on two incoherent point sources being evaluated.
Figures 5A, 5B, 5C, 5D, 5E, 5F:
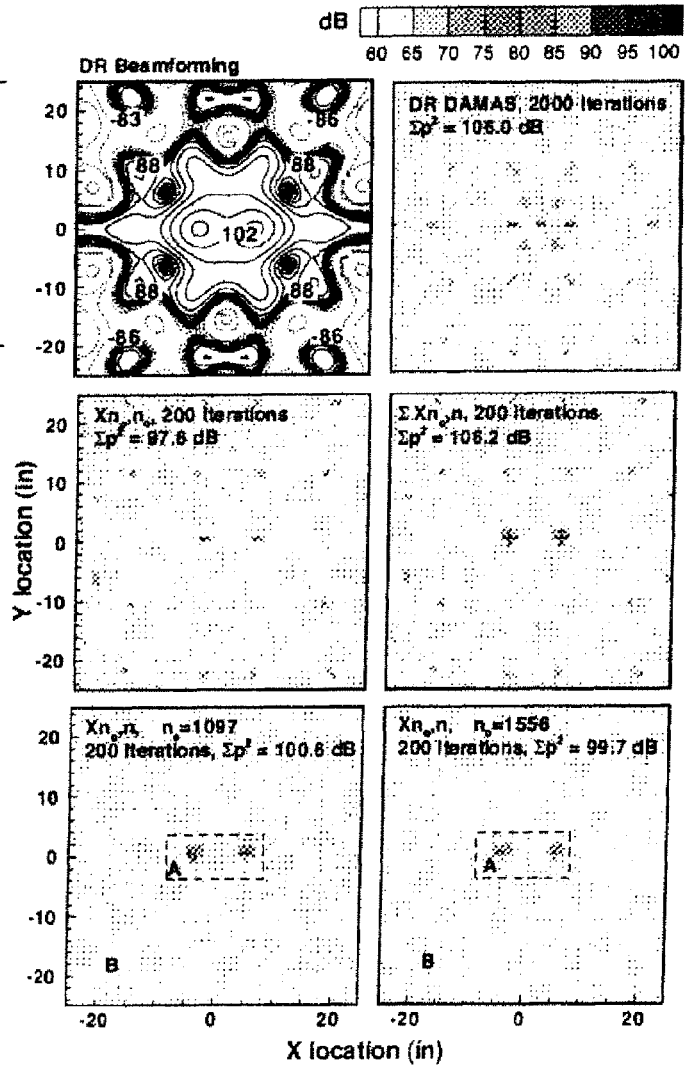
FIGS. 5A-F illustrate beamforming and corresponding results for both DAMAS and DAMAS-C based on two coherent point sources being evaluated.
Figures 6A, 6B, 6C, 6D, 6E, 6F:
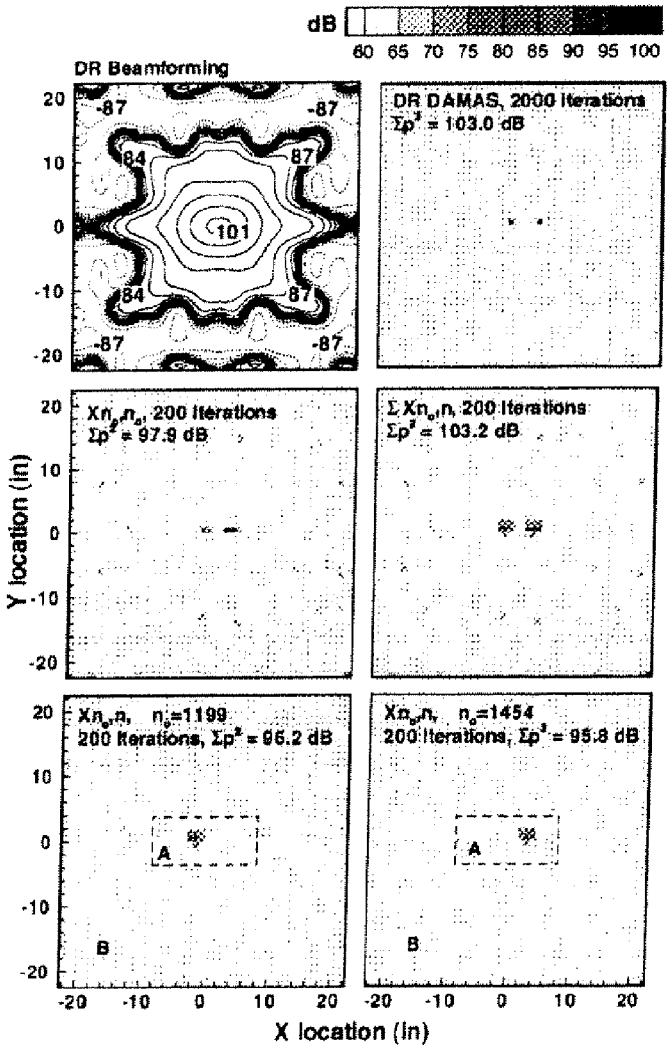
FIGS. 6A-F illustrate beamforming and corresponding results for both DAMAS and DAMAS-C based on two incoherent point sources located closer together than the sources used in FIGS. 4A-F being evaluated.
Figures 7A, 7B, 7C, 7D, 7E, 7F:
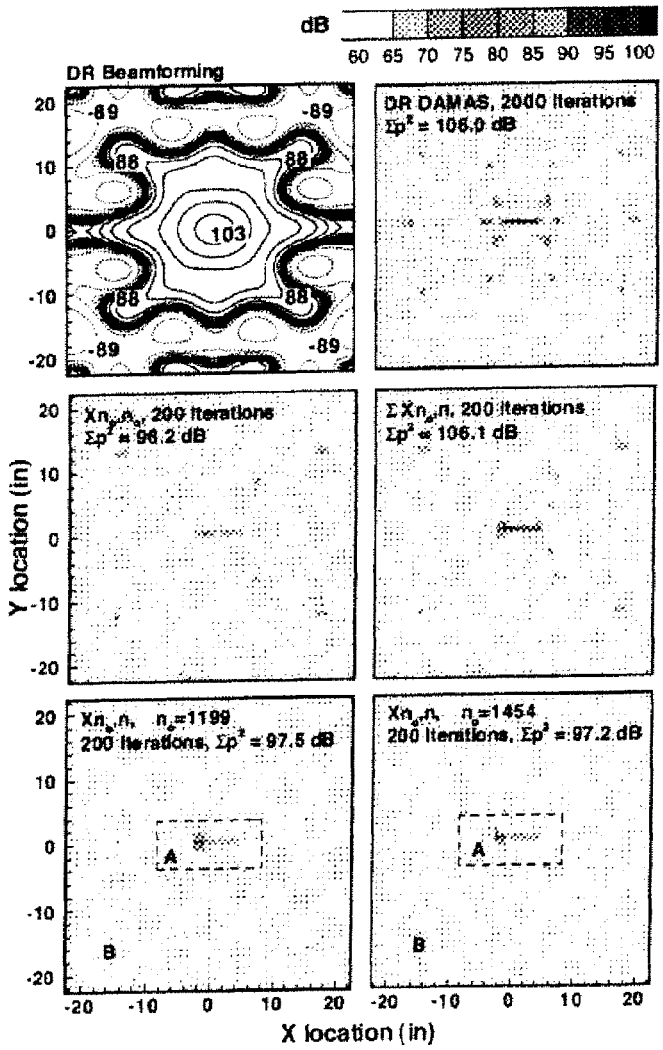
FIGS. 7A-F illustrate beamforming and corresponding results for both DAMAS and DAMAS-C based on two coherent point sources located closer together than the sources used in FIGS. 5A-F being evaluated.
Figures 8A, 8B, 8C, 8D, 8E, 8F:
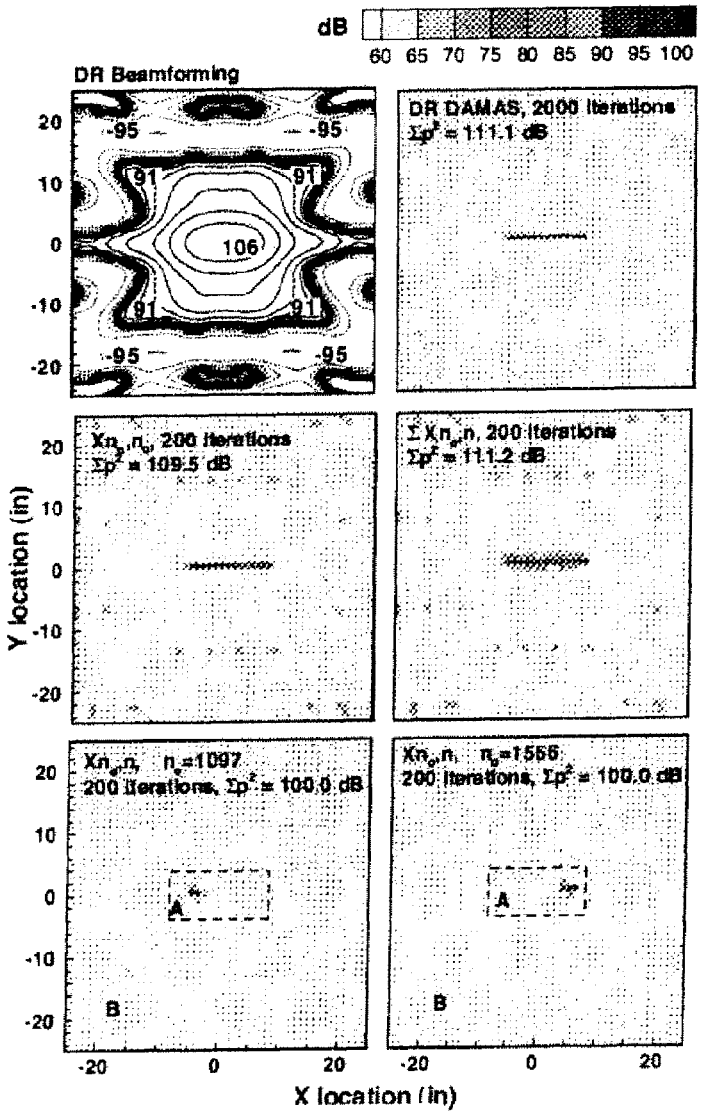
FIGS. 8A-F illustrate beamforming and corresponding results for both DAMAS and DAMAS-C based on two incoherent simulated line sources comprised of several point sources in a line.
Figures 9A, 9B, 9C, 9D, 9E, 9F:
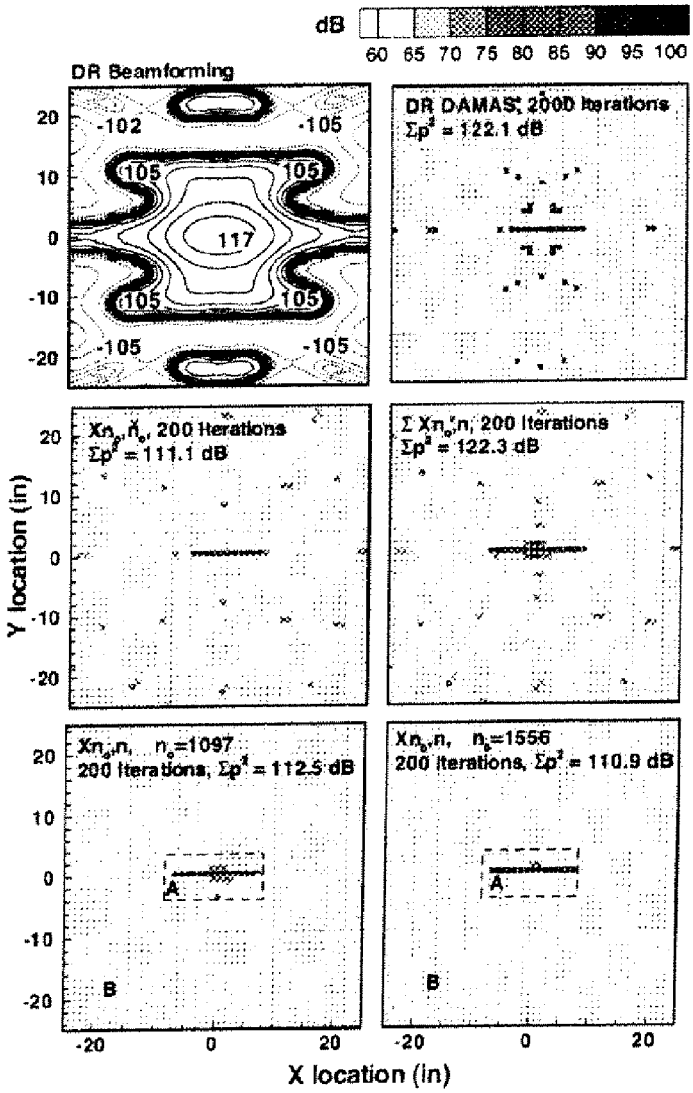
FIGS. 9A-F illustrate beamforming and corresponding results for both DAMAS and DAMAS-C based on two coherent simulated line sources comprised of several point sources in a line.

Unlike the referenced Ser. No. 11/126,518, where presentations were of beamforming and solutions over the scan plane of N points, the present invention often presents results over individual $n_0$ planes with grid points n=1, 2, 3, N. FIG. 2 illustrates all N of the $n_0$ planes. Notice each $n_0$ plane contains all cross-beamforming responses $Y_{non}$ over n=1, 2, 3, N which includes standard beamform response $Y_{non_o}$ at $n_o$.

The pressure transform of a microphone is related to a modeled source at a position n in the source field by the equation as described in the referenced Ser. No. 11/126,518 and by the following equation:

$$P_{m:n} = Q_n e_{m:n}^{-1} \tag{5}$$

However, it is presently desired to find a more general distribution for the CSM than that of a distribution of uncorrelated sources at different n. Using equation (5) the cross spectrum between microphones m and m' for a distribution of sources over all N grid points is given by:

$$P^*_m P_{m'} = \sum_{n'_0} \sum_{n'} \left(Q_{n'_0} e^{-1}_{mn'_0}\right)^* \left(Q_{n'} e^{-1}_{m'n'}\right) \tag{6}$$

This reflects the acoustic pressure perceived at microphone m due to the sources at n', $n_0$, $n'_0$, and n are generally different than that perceived at microphone m' for the same sources. As in the referenced Ser. No. 11/126,518 the $G_{mm'}$ terms of the CSM are proportional to the corresponding $P^*_m P_{m'}$ terms.

$$G_{mm'} = \sum_{n'_o} \sum_{n'} X_{n'_o n'} \left(e^{-1}_{mn'_o}\right)^* e^{-1}_{m'n'} \tag{7}$$

where $$X_{n'_o n'} = Q^*_{n'_o} Q_{n'} \tag{8}$$

$X_{n'_o n}$ represents the mean-square cross-spectral pressure per bandwidth, due to coherent portion between the sources at $n_o'$ and n', at the microphone m including some normalization. The value given by $X_{n'_o n'}$ is the primary objective when using DAMAS-C. It is important to note that if the sources at $n_o'$ and n' radiate noise in a statistically independent way then $X_{n'_o n'}=0$. Specifically, if $X_{n'_o n'}=0$ when $n_o' \neq n'$ the result collapses to that found in the referenced Ser. No. 11/126,518.

For the case of a coherent source the CSM is $G_{modC}$ with components given by equation (7). Using equation (1) we find $$(Y_{n_o n})_{mod} = \frac{\hat{e}^T_{n_o} \sum_{n'_o} \sum_{n'} X_{n'_o n'} [\,]_{n'_o n'} \hat{e}_n}{m_0^2} \quad n = \frac{\sum_{n'_o} \sum_{n'} \left(\hat{e}^T_{n_o} [\,]_{n'_o n'} \hat{e}_n\right) X_{n'_o n'}}{m_0^2} \tag{9}$$

Where the bracketed term is $$[\,]_{n'_o n'} = \begin{bmatrix} \left(e^{-1}_{1n'_o}\right)^* e^{-1}_{1n'} & \left(e^{-1}_{1n'_o}\right)^* e^{-1}_{2n'} & \dots & \left(e^{-1}_{1n'_o}\right)^* e^{-1}_{m_0 n'} \\ \left(e^{-1}_{2n'_o}\right)^* e^{-1}_{n'} & \left(e^{-1}_{2n'_o}\right)^* e^{-1}_{2n'} & & \vdots \\ & & \ddots & \vdots \\ & & & \left(e^{-1}_{m_0 n'_o}\right)^* e^{-1}_{m_0 n'} \end{bmatrix} \tag{10}$$

Noting that we can look at explicit terms of equation (9) by inserting actual values for n',$n_0$,$n_o'$ and n, the following is found:

$$\hat{Y}_c = \hat{A}_c \hat{X}_c \tag{11}$$

Notice equation (11) is the same form as used in the referenced Ser. No. 11/126,518. However here $\hat{X}_c$ and $\hat{Y}_c$ have $N^2$ complex-number solutions rather than N real-number components. $\hat{A}_c$ has $N^4$ complex-number components rather than $N^2$ real-number components. The components of $\hat{A}_c$ are given by:

$$\hat{A}_{n_o n, n'_o n'} = \frac{\left(\hat{e}^T_{n_o} [\,]_{n'_o n'} \hat{e}_n\right)}{m_0^2} \tag{12}$$

Where $[\,]_{n'_o n'}$ is defined by equation 10, and the order in $\hat{A}_c$ is defined by:

$$\hat{A}_c = X_n \begin{bmatrix} A_{11.11} & A_{11.12} & \cdots & A_{11.NN} \\ A_{12.11} & A_{12.12} & & \vdots \\ & & \ddots & \vdots \\ A_{NN.11} & & & A_{NN.NN} \end{bmatrix} \tag{13}$$

The above equations contain terms that are complex conjugates of each other. Further, for the diagonal terms of equation (13) (i.e. when $n_o n = n'_o n'$) the value of $\hat{A}_c$ for that element is 1. These relationships explain why in the present formulation there are potentially N(N+1)/2 independent equations and unknowns. Therefore, taking advantage of the complex conjugate relationships the problem is reduced in size from that indicated by the equations above.

It is noteworthy that modified beamforming such as shaded standard, diagonal removal (DR), and shaded DR beamforming, as described in the referenced Ser. No. 11/126,518 may be applied in a similar manner. All such special beamforming processes leave the relationships described above equally valid.

To begin solving the DAMAS-C inverse problem, consider the following component of equation (11):

$$Y_{n_o n} = \sum_{n'_o=1}^{N} \sum_{n'=1}^{N} A_{n_o n, n'_o n'} X_{n'_o n'} \tag{14}$$

This equation rearranged (with the appropriate special relationships noted above accounted for) gives:

$$X_{n_o n} = Y_{n_o n} - \left[ \begin{array}{l} \displaystyle\sum_{n'_o=1}^{n_o} \sum_{n'=1}^{n-1} A_{n_o n, n'_o n'} X_{n'_o n'} + \\ \displaystyle\sum_{n'_o=1}^{N} \sum_{n'=n+1}^{N} A_{n_o n, n'_o n'} X_{n'_o n'} \end{array} \right] \tag{15}$$

This equation is used in an iteration algorithm to obtain the source distribution strengths $X_{nn}$ (or $X_{nono}$) for all n and cross strengths $X_{non}$ for all combinations of $n_o$ and n based on the following equation.

$$X^{(i)}_{n_o n} = Y_{n_o n} - \left[ \begin{array}{l} \displaystyle\sum_{n'_o=1}^{n_o} \sum_{n'=1}^{n-1} A_{n_o n, n'_o n'} X^{(i)}_{n'_o n'} + \\ \displaystyle\sum_{n'_o=1}^{N} \sum_{n'=n+1}^{N} A_{n_o n, n'_o n'} X^{(i-1)}_{n'_o n'} \end{array} \right] \tag{16}$$

Notice the similarity of this form to that given in the referenced Ser. No. 11/126,518. The fundamental difference that arises is that the terms here are complex and the problem size for the same number of N grid points is increased.

The iteration path is consistent with a progression through a stack of solution maps. FIG. 2 illustrates N planes, where within each, the counting sequence starts in the left bottom corner at n=1 and increases vertically along each column. For each iteration the value of $X^{(i)}_{n_o n}$ replaces the previous iteration $X^{(i-1)}_{n_o n}$ value. Thus, equation 16 represents the solution to the DAMAS-C inverse problem described by equation 11.

In the referenced Ser. No. 11/126,518 a positivity constraint was used in order to render the solutions sufficiently deterministic. That positivity constraint was physically necessary. A similar type of constraint is necessary in the present application. In DAMAS-C the value of $X_{non}$ is a complex quantity of the form $Re(X_{non})+Im(X_{non})$. When $n=n_o$, $X_{non}=X_{nono}$ is real and positive, this is equivalent to the DAMAS $X_n$ which is the autospectral pressure-squared (positive) amplitude of sources. Thus, for each iteration of equation (16), $Im(X_{nono})$ are set to zero and $Re(X_{nono})$ are set to zero only if the value is negative. This is equivalent to the positivity constraint described in the referenced Ser. No. 11/126,518.

When $n \neq n_o$. $X_{non}$ could be in any of four complex quadrants. In terms of a complex coherence definition this is represented by the following equation:

$$X_{non} = \gamma_{n_o n} \sqrt{X_{nn}} \sqrt{X_{nono}} \tag{17}$$

Where the coherence is described as:

$$\overline{\gamma^2_{n_o n}} = \overline{\gamma^2_{n n_o}} = \frac{\overline{X^2_{n_o n}}}{X_{n_o n_o} X_{nn}} = \frac{X^*_{n_o n} X_{n_o n}}{X_{n_o n_o} X_{nn}} \tag{18}$$

$$\gamma_{n_o n} = \sqrt{\overline{\gamma_{n_o n}}}\, e^{j\Phi_{n_o n}} \tag{19}$$

Here, $\Phi_{n_o n}$ is the phase between coherent portions of the source at point n with respect to $n_o$. Physically, $\gamma_{n_o n}$ is interpreted as the coherence factor between the sources at n and $n_o$. This can be related to noise emission from unsteady aerodynamic related regions over radiating sources or reflections.

An appropriate constraint based on the above analysis could be enforced in the iterations. However, here $X_{non}$ is regarded as an independent variable just like $X_{non_o}$ and $X_{nn}$.

Regarding the generality of $X_{non}$, there is a remaining question about the rank of the DAMAS-C inverse problem. This gives rise to concerns about the practicality of solving $X_{non}$ with arbitrary phase. Thus, in the present application example sources are limited to those having in-phase coherence ($\Phi_{n_o n}=0$) For this example, after each iteration in the $n \neq n_o$ case, both the imaginary and real parts of $X_{non}$ are set to zero if the value is not already positive. However, the phase $\Phi_{n_o n}$ can be specified as being functionally or defined as a constant.

Finally, in an effort to manage the large matrices involved in evaluation of $\hat{Y}_c = \hat{A}_c \hat{X}_C$ in DAMAS-C applications, reduction by zoning is used. Zoning is employed to restrict the possible solutions to anticipated conditions of the noise source evaluation region under study. The evaluation region can be composed of a number of grid point zones, each with assumed coherence criteria. The criteria can be uniform over the zones or functionally dependent on, for example, the point-to-point distance and frequency.

In the present application, the source evaluation region is composed of multiple non-congruent Zones A and B containing grid points $(n)_A$ and $(n)_B$. Zone A is taken as a region of coherent sources, while Zone B is composed of completely incoherent sources. This means cross terms $\hat{X}_{(n'_0)_A (n')_B}$ are zero. Similarly, $\hat{X}_{(n'_0)_B (n')_B}$ when $n_o \neq n$. This leads to the zeroing out of corresponding $\hat{A}_c$ matrix columns. Now to follow the iteration scheme, the cross $\hat{Y}c$ terms and corresponding $\hat{X}c$ terms and the corresponding matrix rows of $\hat{A}_c$ are eliminated. Even though the $\hat{Y}c$ cross terms themselves are not zero, their elimination reduces the number of equations and unknowns while still giving weight in the solutions to Zone B through the auto terms of $\hat{Y}_c$. The zoning method described above can give rise to a substantial reduction in the size of the problem, thus making what might otherwise be an untenable computational method attractive.

FIGS. 1A-D illustrate graphs representing output dB contours over scan planes of Beamforming, and $Y_{non_o}$ and cross beamforming $Y_{n_on}$ between grid points at $n_o$ and n. FIGS. 1A-D actually illustrate the simplest case, with no issues of coherence or multiple sources. The example is of a scan plane placed 60 inches from the 7.8 inch diameter SADA microphone array. The frequency used was 20 kHz. The scan plane is comprised of a 15×15 grid pattern of points where Δx=Δy=1.5 inches. The half-power beamwidth, $B_{auto}$, is approximately 7 inches. The corresponding beamwidth $B_{cross}$ is approximately 10.5 inches. Criteria given in the referenced Ser. No. 11/126,518 for resolution range is similarly applicable, and was met here. Those criteria are:

$$0.05 \leqq \Delta x/B \text{ (or } \Delta y/B) \leqq 0.2 \tag{20}$$

and $$1 \leqq W/B \text{ (and } H/B). \tag{21}$$

All 225 grid points are considered in Zone A, where coherence is permitted. The point source is located at n=113. $Y_{n_on}$ is then solved over the scan plane and plotted in graph 110 illustrated in FIGS. 1A-D.

FIG. 2 illustrates a stack of individual planes 200, representing the DAMAS-C results for $X_{non_o}$ and $X_{non}$ corresponding to the $Y_{non_o}$ and $Y_{n_on}$ plots of FIGS. 1A-D. These were determined using the algorithm from equation (16) using i=100 iterations. FIGS. 3A-D are graphs 300 illustrating levels $X_{non_o}$ which represent the collection of $X_{n_on}$ values, when $n=n_o$, from the individual $n_o$ planes. Graph 310 illustrates that DAMAS-C, with this number of iterations, approaches the correct source definition. The value found for $X_{113113}$ was 96.5 dB, only slightly differing from the actual value of 100 dB. The nearby $X_{n_on}$ levels were about 89 dB (the exact value being −∞). Finally, the result of a total of all the grid points was 100.2 dB with the exact value being 100 dB. Of course, an increase in the number of iterations preformed would increase accuracy. Here, the relatively low number of iterations illustrates "energy" smearing seen when fewer iterations are preformed.

Next the ability of DAMAS-C to separate and quantify different sources was tested. FIGS. 4A-F illustrate diagramed results for two incoherent sources positioned 9 inches apart on a 51×51 inch scan plane with a grid point spacing of Δx=Δy=1 inch. The top left frame 410 is an illustration of beamforming. The top right frame 420 is a DAMAS processed result using methods described in the referenced Ser. No. 11/126,518. Since the sources are incoherent, application of DAMAS correctly yields location and level, 103 dB (100 dB being the correct result) of the sources. This frame shows 2000 iterations.

Subsequent frames of FIGS. 4A-F, in particular frames 430 and 440, show distributions of $X_{non_o}$ the sum of $X_{n_on}$ over all planes, $X_{n_on}$ (for source location $n_o$=1097 plane), and $X_{n_on}$ (for source location $n_o$=1556 plane). This shows DAMAS-C correctly identifies the sources. The results indicate some smearing due to the limited number of iterations. Frames 410 and 420 illustrate the key result; that DAMAS-C correctly separates the sources and validates that the two sources have no coherence with one another.

FIGS. 5A-F illustrate graphical results for two sources defined as perfectly coherent and in-phase. The configuration used to obtain FIGS. 5A-F is identical to that of FIGS. 4A-F. The first frame 510 of FIGS. 5A-F shows a geometrically distorted result, although the sum of apparent sources is nearly correct. However, DAMAS-C is shown to correctly separate and quantify the coherent sources. Although the levels are slightly lower than the actual results this is explained by the same resolution energy smearing phenomena as described above.

FIGS. 6A-F and FIGS. 7A-F are graphs illustrating a similar set of results to those illustrated in FIGS. 4A-F and FIGS. 5A-F. In these experiments the sources were placed closer together (spaced by 4.5 inches) with Δx=Δy=0.9 inches. For the graphs in FIGS. 6A-F, the sources used were incoherent. As expected, almost the same degree of success in source definition is found using DAMAS and DAMAS-C. However, graphs in FIGS. 7A-F illustrate the difficulty that can be encountered when the sources are coherent. In FIGS. 7A-F, the totaled $\Sigma X_{non}$ frame result appears almost as a line 710 and the $X_{non}$ frames show smearing between the sources. However, following criteria for resolvability detailed by the referenced Ser. No. 11/126,518, the present DAMAS-C results appear compatible with these criteria.

FIGS. 8A-F and FIGS. 9A-F illustrate graphs for a set of presentations, similar to the preceding, except that thirteen sources are distributed to simulate a 12-inch line source. Graphs in FIGS. 8A-F illustrate for the incoherent line source, that both DAMAS and DAMAS-C give good spatial and level definition. The graphs in FIGS. 9A-F illustrate a presentation for a coherent line source. The DAMAS result is substantially distorted, although the total levels for both DAMAS and DAMAS-C are correct. The results of these and the preceding figures validate the correctness and functionality of the DAMAS-C algorithm.

Figure 10:
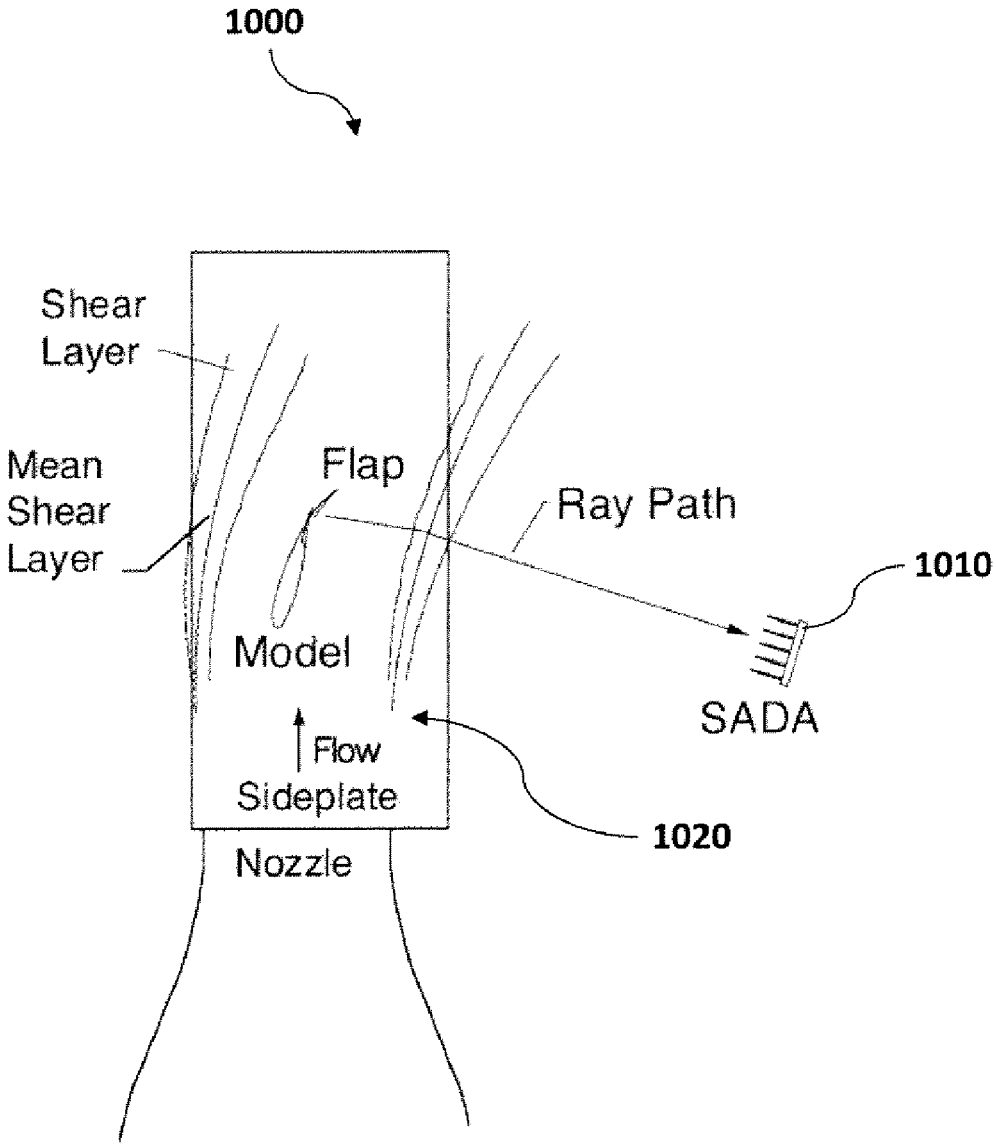
FIG. 10 illustrates the setup used to conduct a flap noise test in a Quiet Flow Facility.
Figures 11A, 11B, 11C, 11D, 11E, 11F, 11G, 11H:
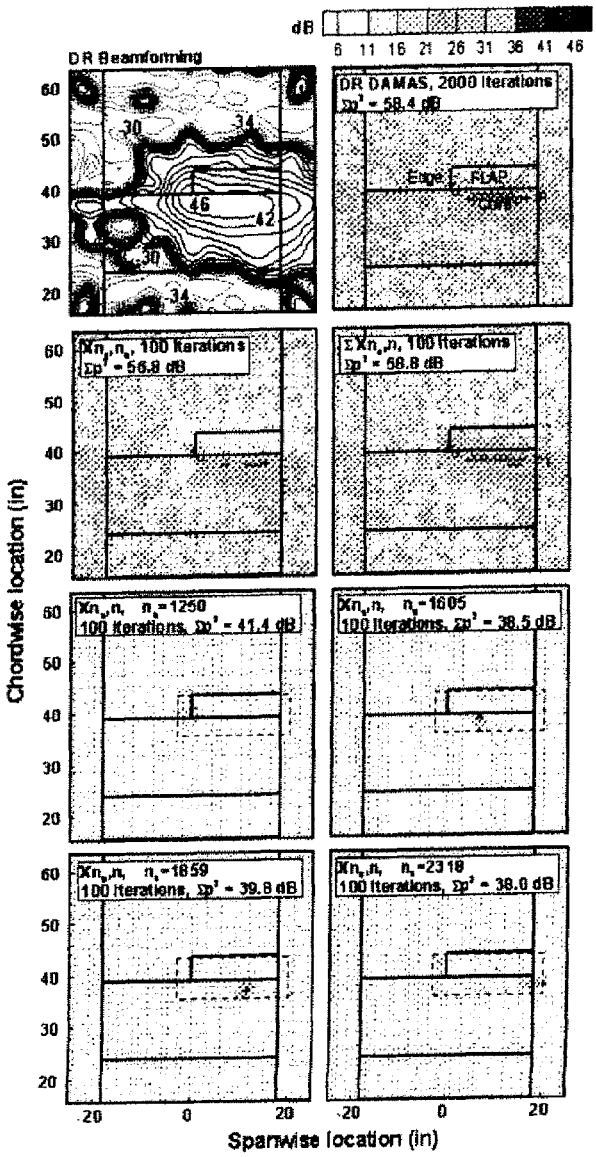
FIGS. 11A-H illustrate beamforming and corresponding results for both DAMAS and DAMAS-C based on data gathered from the flap noise test.

DAMAS-C was applied to data collected from an airframe noise test in a Quiet Flow Facility. FIG. 10 illustrates the flap edge test system 1000 configuration. The SADA array 1010 is positioned outside the flow field of the system 1000 at a distance of 5 feet from the flow model 1020. In this test the flap angle 1030 was set at 29 degrees and M=0.11. Sources were evaluated along a scanning plane aligned with an airfoil main element chordline.

The DR beamform processing and corresponding DAMAS results are shown as graphs in FIGS. 11A-H. Zone A is a 9×24 point region over the scan plane with grid spacing Δx=Δy=1 inch. The results illustrated in FIGS. 11A-H illustrate that the results for DAMAS and DAMAS-C substantially match in source and distribution levels. This suggests the flap edge and flap cove noise regions can be regarded as distributions of incoherent sources to the extent that is resolvable for this size array and processing.

Figure 12:
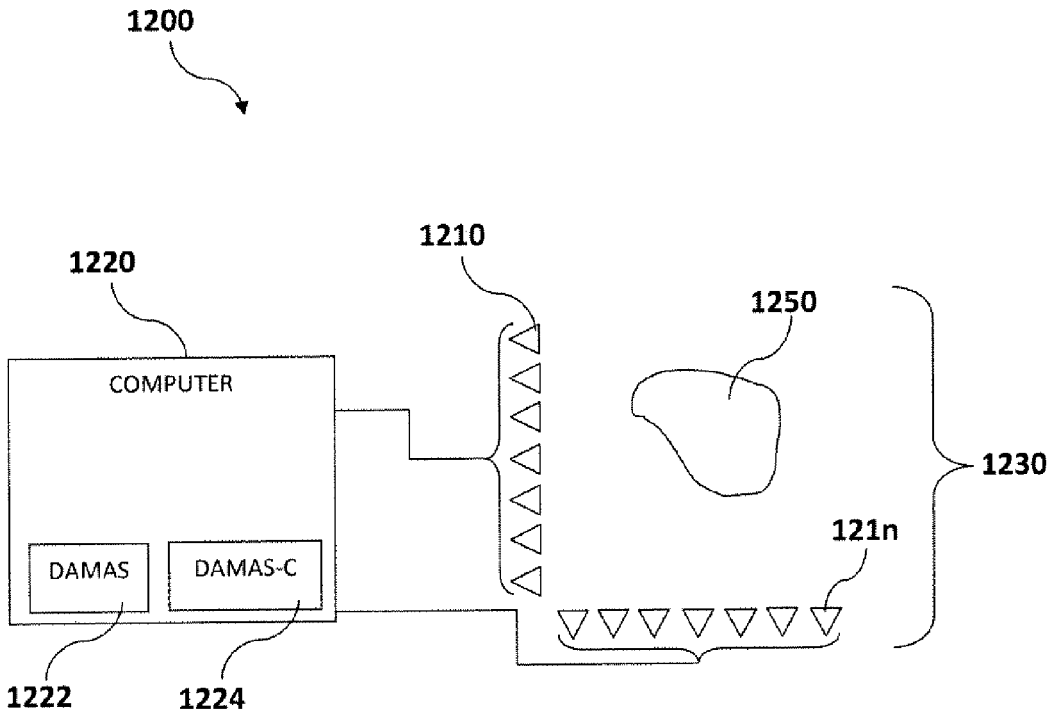
FIG. 12 illustrates a block diagram of a system adapted for mapping coherent and incoherent acoustic sources determined from a phased microphone array.

Referring to FIG. 12, a block diagram 1200 of a system in accordance with features of the present invention is illustrated. The system 1200 is adapted for mapping coherent and incoherent acoustic sources 1250 determined from a phased microphone array and includes a plurality of microphones 1210-121*n* arranged in an optimized grid pattern 1230 and including a plurality of grid locations thereof. Also included in the system 1200 is a computer 1220 connected to the plurality of microphones 1210-122*n*, the computer 1220 adapted for processing any combination of DAMAS 1222 or DAMAS-C 1224 modules including: a linear configuration of equations and unknowns formed by accounting for cross-beamforming characteristic thereof at varying grid locations among said plurality of grid locations; an equation iteratively determined from said linear configuration of equations and unknowns based on a DAMAS-C inverse formulation; and an optimized noise source distribution generated over an identified aeroacoustic source region 1250 associated with said phased microphone array in order to compile an output presentation thereof, in response to iteratively determining said equation among said linear configuration of equations and unknowns.

Figure 13:
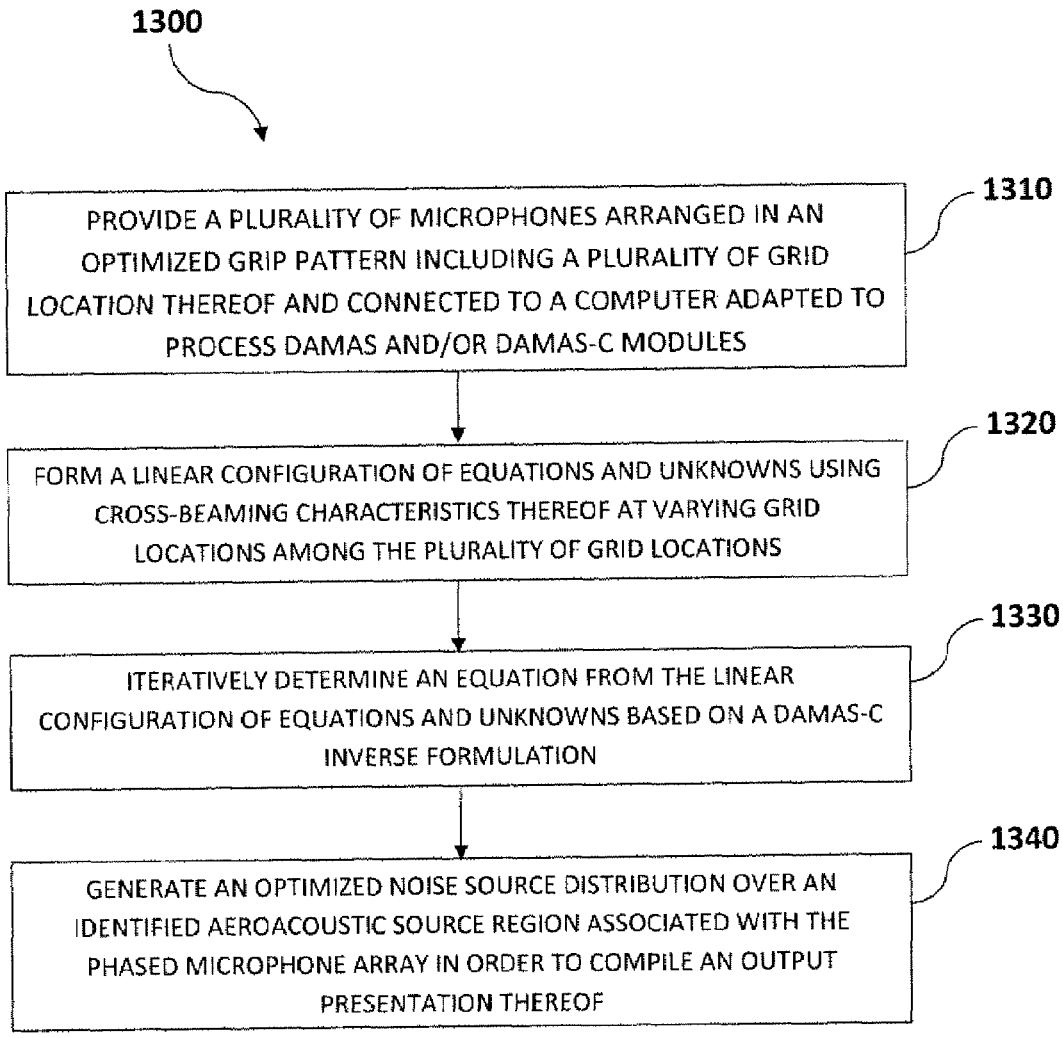
FIG. 13 illustrates a flow diagram of a method for mapping coherent acoustic sources determined from a phased microphone array.

Referring to FIG. 13, a flow diagram 1300 of a method for mapping coherent acoustic sources determined from a phased microphone array that can be followed in accordance with carrying out aspects of the present invention is illustrated. As shown in Block 1310, a plurality of microphones arranged in an optimized grip pattern including a plurality of grid location thereof and connected to a computer adapted to process DAMAS and/or DAMAS-C modules is provided. As shown in Block 1320, a linear configuration of equations and unknowns are formed using cross-beaming characteristics thereof at varying grid locations among the plurality of grid locations. An equation is then iteratively determined from the linear configuration of equations and unknowns based on a DAMAS-C inverse formulation, as shown in Block 1330. Then, as shown in Block 1340, an optimized noise source distribution is generated over an identified aeroacoustic source region associated with the phased microphone array in order to compile an output presentation thereof. Generation of the optimized noise source distribution can be in response to iteratively determining the equation among the linear configuration of equations and unknowns, thereby removing the beamforming characteristic from the output presentation.

The linear configuration can further comprise a system of linear equations including $\hat{Y}_c=\hat{A}_c\hat{X}_c$, wherein said system of linear equations relates a spatial field of point locations with beamformed array-output responses thereof to equivalent source distributions at a same location. A variable $\hat{A}$ among the system of linear equations can be utilized to disassociate an array thereof from acoustic sources of interest. Solving for a variable x among said system of linear equations can further include the equation $\hat{Y}_c=\hat{A}_c\hat{X}_c$. The variable $\hat{X}$ can be allowed to be an imaginary number with a real part and imaginary part. Iteratively determining the equation among the linear configuration of equations and unknowns can further include the step of attaining the equation utilizing a solution requirement of a constraint that sets the phase of said variable $\hat{X}$. If phase is limited to zero then the imaginary part of $\hat{X}$ is set to zero if it is already not positive. Iteratively determining the equation among said linear configuration of equations and unknowns can also include the step of attaining the equation utilizing a reduction of the size of the problem by zoning.

It is important to note that the methodology described above with respect to the figures and equations, which is referred to generally by the DAMAS or DAMAS-C acronym, can be implemented in the context of a module(s). In the computer programming arts, a module (e.g., a software module) can be implemented as a collection of routines and data structures that perform particular tasks or implement a particular abstract data type. Modules generally can be composed of two parts. First, a software module may list the constants, data types, variable, routines and the like that that can be accessed by other modules or routines. Second, a software module can be configured as an implementation, which can be private (i.e., accessible perhaps only to the module), and that contains the source code that actually implements the routines or subroutines upon which the module is based.

Thus, for example, the term "module," as utilized herein generally refers to software modules or implementations thereof. The world module can also refer to instruction media residing in a computer memory, wherein such instruction media are retrievable from the computer memory and processed, for example, via a microprocessor. Such modules can be utilized separately or together to form a program product that can be implemented through signal-bearing media, including transmission media and recordable media.

Accordingly, a program product for mapping coherent and incoherent acoustic sources determined from a phased microphone array can be provided in accordance with features of the present invention. The program product can include a plurality of microphones which can be arranged in an optimized grid pattern including a plurality of grid locations thereof, instruction media residing in a computer memory for forming a linear configuration of equations and unknowns by accounting for a reciprocal influence of a cross-beamforming characteristic thereof at varying grid locations among said plurality of grid locations, instruction media residing in a computer for iteratively determining an equation from said linear configuration of equations and unknowns based on a DAMAS-C inverse formulation and instruction media residing in a computer for generating an optimized noise source distribution over an identified aeroacoustic source region associated with said phased microphone array in order to compile an output presentation thereof, in response to iteratively determining said equation among said linear configuration of equations and unknowns, thereby removing said beamforming characteristic from said output presentation. Each of said instruction media residing in a computer can be comprised of signal-bearing media. The signal-bearing media can also comprise at least one of the following types of media: transmission media or recordable media.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed as new and desired to be secured by Letters of Patent of the United States is:

1. A method for mapping coherent or incoherent acoustic sources determined from a phased microphone array, comprising the steps of:

arranging a plurality of microphones in a grid pattern wherein a plurality of grid locations thereof, are defined;

providing a computer connected to said plurality of microphones for receiving signals generated by said microphones in response to sound sensed thereby;

forming, using said computer, a linear configuration of equations and unknowns using cross-beamforming characteristics based on said signals generated at varying grid locations among said plurality of grid locations;

iteratively determining, using said computer, an equation from said linear configuration of equations and unknowns based on a DAMAS-C inverse formulation;

generating, using said computer, an optimized noise source distribution over an identified aeroacoustic source region associated with said phased microphone array in response to said step of iteratively determining said equation among said linear configuration of equations and unknowns; and compiling, using said computer, an output presentation of said optimized noise source distribution wherein said cross-beamforming characteristics are not present therein.

2. The method of claim 1, wherein said linear configuration further comprises a system of linear equations comprising $\hat{Y}_c=\hat{A}_c\hat{X}_c$, wherein said system of linear equations relates a spatial field of point locations with beamformed array-output responses thereof to equivalent source distributions at a same location.

3. The method of claim 2, wherein a variable $\hat{A}$ among said system of linear equations is utilized to disassociate an array thereof from acoustic sources of interest.

4. The method of claim 2, further comprising the step of solving for a variable $\hat{X}$ among said system of linear equations comprising $\hat{Y}_c=\hat{A}_c\hat{X}_c$.

5. The method of claim 4, further comprising the step of allowing said variable $\hat{X}$ to be an imaginary number with a real part and imaginary part.

6. The method of claim 4, wherein said step of iteratively determining said equation among said linear configuration of equations and unknowns further comprises the step of attaining said equation utilizing a solution requirement of a constraint that sets real and imaginary parts of said variable $\hat{X}$ to zero when said parts are not positive after each iteration.

7. The method of claim 1, wherein said step of iteratively determining said equation among said linear configuration of equations and unknowns further comprises the step of attaining said equation utilizing zoning.

8. A computer system for mapping coherent and incoherent acoustic sources determined from a phased microphone array formed by a plurality of microphones arranged in a grid pattern with a plurality of grid locations thereof being defined and said plurality of microphones generating signals in response to sound sensed thereby, said computer system comprising a computer for forming a linear configuration of equations and unknowns by accounting for a reciprocal influence of a cross-beamforming characteristic based on said signals at varying grid locations among said plurality of grid locations;

said computer iteratively determining an equation from said linear configuration of equations and unknowns based on a DAMAS-C inverse formulation;

said computer generating an optimized noise source distribution over an identified aeroacoustic source region associated with said phased microphone array in response to said equation so-iteratively determined among said linear configuration of equations and unknowns; and said computer compiling an output presentation of said optimized noise source distribution wherein said cross-beamforming characteristic is not present in said output presentation.

9. The computer system of claim 8, wherein said linear configuration further comprises a system of linear equations comprising $\hat{Y}_c=\hat{A}_c\hat{X}_c$, wherein said system of linear equations relates a spatial field of point locations with beamformed array-output responses thereof to equivalent source distributions at a same location.

10. The computer system of claim 9, wherein a variable $\hat{A}$ among said system of linear equations is utilized to disassociate an array thereof from acoustic sources of interest.

11. The computer system of claim 9, wherein said computer solves for a variable $\hat{X}$ among said system of linear equations comprising $\hat{Y}_c=\hat{A}_c\hat{X}_c$.

12. The computer system of claim 11, wherein said computer iteratively determining said equation among said linear configuration of equations and unknowns further comprises attaining said equation utilizing a solution requirement of a constraint that sets real and imaginary parts of said variable $\hat{X}$ to zero when said parts are not positive after each iteration.

13. The computer system of claim 8, wherein said computer iteratively determining said equation among said linear configuration of equations and unknowns further comprises attaining said equation utilizing zoning.

14. A system for mapping coherent and incoherent acoustic sources determinable from phased microphone arrays, comprising:

a plurality of microphones arranged in a grid pattern wherein a phased microphone array is formed with a plurality of grid locations thereof being defined, said plurality of microphones generating signals in response to sound sensed thereby; and a computer connected to said plurality of microphones, said computer:

processing a linear configuration of equations and unknowns formed by accounting for cross-beamforming characteristics based on said signals at varying grid locations among said plurality of grid locations, iteratively determining an equation from said linear configuration of equations and unknowns based on a DAMAS-C inverse formulation, generating an optimized noise source distribution over an identified aeroacoustic source region associated with said phased microphone array in response to said equation so-iteratively determined among said linear configuration of equations and unknowns, and compiling an output presentation of said optimized noise distribution wherein said cross-beamforming characteristics are not present in said output presentation.

15. The system of claim 14, wherein iteratively determining said equation among said linear configuration of equations and unknowns further comprises attaining said equation utilizing zoning.

16. The system of claim 14, wherein said linear configuration further comprises a system of linear equations relating a spatial field of point locations with beamformed array-output responses thereof to equivalent source distributions at a same location.

17. The system of claim 16, wherein a variable $\hat{A}$ among said system of linear equations is utilized to disassociate an array thereof from acoustic sources of interest.

18. The system of claim 16, further comprising solving for a variable $\hat{X}$ among said system of linear equations comprising $\hat{Y}_c=\hat{A}_c\hat{X}_c$.

19. The system of claim 18, wherein iteratively determining said equation among said linear configuration of equations and unknowns further comprises attaining said equation utilizing a solution requirement of a constraint that sets real and imaginary parts of said variable $\hat{X}$ to zero when said parts are not positive after each iteration.

* * * * *